US008981199B2

(12) United States Patent
Loh et al.

(10) Patent No.: US 8,981,199 B2
(45) Date of Patent: Mar. 17, 2015

(54) MIDI COMMUNICATION HUB

(75) Inventors: Michael Loh, Calgary (CA); Demetrio Navarro, Calgary (CA); Ed Geeraert, Calgary (CA); Scott Juskiw, Calgary (CA)

(73) Assignee: iKingdom Corp., Alberta (CA)

( * ) Notice: Subject to any disclaimer, the term of this patent is extended or adjusted under 35 U.S.C. 154(b) by 795 days.

(21) Appl. No.: 13/010,701

(22) Filed: Jan. 20, 2011

(65) Prior Publication Data

US 2011/0174138 A1 Jul. 21, 2011

Related U.S. Application Data

(60) Provisional application No. 61/296,504, filed on Jan. 20, 2010.

(51) Int. Cl.
*G10H 7/00* (2006.01)
*G10H 1/00* (2006.01)

(52) U.S. Cl.
CPC ..... *G10H 1/0066* (2013.01); *G10H 2240/325* (2013.01)
USPC ..... 84/645

(58) Field of Classification Search
USPC ..... 84/645
See application file for complete search history.

(56) References Cited

U.S. PATENT DOCUMENTS

| | | | |
|---|---|---|---|
| 5,983,280 | A | 11/1999 | Hunt |
| 6,342,666 | B1 | 1/2002 | Shutoh |
| 7,531,737 | B2 | 5/2009 | Ide et al. |
| 7,786,371 | B1 | 8/2010 | Moates |
| 8,478,913 | B2 | 7/2013 | Terlizzi et al. |
| 2004/0074377 | A1 | 4/2004 | Georges |
| 2006/0180008 | A1 | 8/2006 | Negoescu et al. |
| 2007/0276978 | A1 | 11/2007 | Wang et al. |
| 2009/0198848 | A1 | 8/2009 | Chien |
| 2009/0277321 | A1 | 11/2009 | Sturch |
| 2013/0238823 | A1 | 9/2013 | Terlizzi et al. |

FOREIGN PATENT DOCUMENTS

WO 00/60901 10/2000

OTHER PUBLICATIONS

MOTU "MIDI Timepiece AV-USB, MIDI Express XT-USB, micro express-USB" manual, 2000.*
MSB Plus Rev 2 Owners Manual, 1997.*
MOTU, "User Guide: MIDI Express XT, MIDI Express 128, micro express, microlite, Manual", Online, Mark of the Unicorn Inc. 2003, http://s3.amazonaws.com/motu/midi/MOTU_USB_MIDI_Interface_User_Guide_Win.pdf.
UM-3ex Owner's Manual (Online), Roland Corp., 2005, http://lib.roland.co.jp/support/en/manuals/res/1811297/UM-3EX_egfis2.pdf.
"C3USB Five Channel Mobile DJ Mixer with USB", Numark, URL:https://web.archive.org/web/20120123095042/http://www.numark.com/product/c3usb, Jan. 23, 2012.

* cited by examiner

*Primary Examiner* — Jeffrey Donels
(74) *Attorney, Agent, or Firm* — Fish & Tsang, LLP

(57) ABSTRACT

A router for a plurality of MIDI transmitters and receivers routes MIDI event data to and from designated ports without a host computer system connected to the router. Since a host computer system is not used, delay times are significantly reduced and many MIDI devices could be coupled to the router without significantly impacting the transmission speeds of the MIDI data. While the router works without a host connected to the router, the router could still function while a host computer is connected, which is useful when a host computer is used to send MIDI event data or record MIDI event data.

26 Claims, 6 Drawing Sheets

MIDI COMMUNICATION HUB

This application claims the benefit of priority to provisional application No. 61/296,504 filed Jan. 20, 2011.

FIELD OF THE INVENTION

The field of the invention is digital music communication devices.

BACKGROUND

Digital music devices have tong been used to play digital music from a digital music source to a speaker. For example, a CD player can read music encoded in digital format on a CD and then play that music on the speaker connected to the CD player. In the 1980's, the MIDI standard was developed, which allows a digital instrument to send digital event data to a synthesizer, which then produces sounds that correspond to the digital event data. US20070276978 to Wang, for example, teaches a receiver that is connected to a computer using a USB (Universal Serial Bus) port, allowing the computer to send MIDI event data to the digital music receiver which either stores the event data in a storage unit or produces sounds via an audio device. Wang's digital music controller, however, will only map the computer's signal to a single audio output device. Wang and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply. Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

U.S. Pat. No. 6,342,666 to Shutoh, teaches an interface unit with several MIDI inputs and MIDI outputs that could be mapped to one another using a computer coupled to the interface unit. Shutoh's interface unit, however, requires a computer to be coupled to it at all times in order to transfer data from a MIDI input and a MIDI output and the computer then produces more MIDI event data to be sent to corresponding MIDI outputs.

It has yet to be appreciated that MIDI interface units could be produced that do not need a computer coupled to the interface unit to translate event data from a MIDI input to a MIDI output.

Thus, there is still a need for improved MI interface units.

SUMMARY OF THE INVENTION

The inventive subject matter provides apparatus, systems and methods in which a digital music router hostlessly transmits digital music event data from one port to another. As used herein, a "hostless" device is a device that is not coupled to a computer system. As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Generally, the digital music router has a plurality of ports of different kinds, such as MIDI DIN ports (preferably MIDI DIN IN/OUT pairs of ports), USB ports, serial ports, or TRS connectors. In an exemplary embodiment, the digital music router has a plurality of MIDI DIN ports for coupling to MIDI devices and a plurality of USB ports for connecting to a host or a USB hub or USB-MIDI instruments. While the digital music router can transmit digital event data from any port to any other port via a configuration user interface, preferably the digital music router has a default routing configuration that allows a user to immediately use the router without any pre-configuration, allowing for immediate hostless routing multiple MIDI transmitters with multiple MIDI receivers. As used herein, a transmitter is any device that transmits information or data, such as a keyboard, drum pad, host computer system, or electric guitar, and a receiver is any device that receives information or data, such as a synthesizer, a host computer system, or a storage and playback device (a sequencer), which can store and play back events to the originating MIDI device or to other MIDI devices.

Transmitters and receivers could be coupled to the router in a variety of ways. For example, each transmitter and each receiver could be plugged into a separate port on the router. Alternatively, a port could be coupled to a port hub that virtually splits a single port into multiple virtual ports, which are each then individually addressable by the router. Such addressing/enumerating is preferably automatic in the case of generic hubs, for example a 4-port USB hub or a 2-port serial port splitter. In an alternative embodiment, multiple transmitters or receivers could be daisy-chained with one another, and each transmitter and/or receiver is logically addressable by the router. Since music event data generally can not be merely routed from an input port to an output port, the router transmits data by first receiving music event data from a transmitter coupled to a designated input port, reproduces that music event data, and then transmits that reproduced music event data to a designated output port. Once the transmitters and receivers are coupled to the router and addressed by the router system, one could preferably access a user interface that assists a user in determining how music event data is routed from one port to another.

The user interface for the router could be accessed via a touch screen or keypad on the router, but is preferably accessed by a host coupled to the router. A host could be coupled to the router using a physical wire coupling or wirelessly, such as by using a Wi-Fi or Bluetooth connection, and can generally dictate a routing profile that will determine how music event data is handled by the router. Preferably, when a host computer system is coupled to a port on the router, the router can automatically detect that a host computer system is coupled to that port and not a simple MIDI transmitter/receiver.

A routing profile dictated by the user interface could comprise a plurality of instructions for routing music event data, for example by routing music event data from a designated input port to a designated output port, by replicating music event data from a designated input port to two or more designated output ports, by merging data from two designated input ports to a designated output port, by filtering out specific music event data received by an input port, by filtering out specific music event data transmitted to an output port, by translating music event data from an input port using one protocol to music event data to an output port using a different protocol, by designating timing and/or delays between receiving music event data and transmitting music event data, or by transmitting data from two designated input polls in a serial stream with one music event from one port following a music event from a second port. Contemplated protocols include MIDI, USB-MIDI, MIDI (MIDI 2.0), and analog data streams. In an exemplary embodiment, the router is capable of routing data from one MIDI protocol version to another MIDI protocol version.

Once a routing profile is created, the user could then unplug the host computer from the router, and use the router to transmit digital event data to and from a plurality of devices coupled to the router without need of a host coupled to the router. Generally, the router has a processor and a memory to handle such administration and traffic management. Preferably, a user could save one or more routing profiles to the router, and could select different routing profiles using a switch or button on the router, or via the user interface by coupling a host to the router.

While a contemplated router could hostlessly route music event data, a preferred router could also route music event data while one or more hosts are coupled to the router, allowing MIDI event data to be transmitted to or from the host for a variety of purposes. For example, by using a virtual keyboard on a host computer system to send MIDI event data to an attached receiver, or by using a host computer system to record all MIDI event data being routed by the router. This is especially useful for functionality that can only be performed on host computers.

In an exemplary embodiment, the router is embedded within a transmitter (such as an electric piano, an electric guitar, or an electric drum pad) or a receiver (such as a synthesizer, a speaker, or a storage device). In such embodiments, the router performs the dual functionality of routing music event data and transmitting or reproducing music event data.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIGS. 4A and 413 are front and rear views of yet another exemplary router of the present invention.

DETAILED DESCRIPTION

One should appreciate that the disclosed techniques provide many advantageous technical effects including the ability to hose a USB-MIDI device without a host computer coupled to the router, the ability to route MIDI data between a plurality of transmitters and receivers, the ability to route MIDI data between multiple hosts, the ability to route MIDI data between hosts and MIDI instruments, and the ability to route MIDI data between USB-MIDI devices and hosts. As used herein, a "host" system could mean a personal computer system, such as a desktop or a laptop computer, or a handheld computer system, such as a tablet personal computer or a PDA. As used herein, a "handheld" computer host system is a host system that can comfortably be held in a human hand and is typically less than 10 or 5 pounds. For example an iPhone™, iPod™, or an iPad™.

It should be noted that while the embodiments herein disclose personal desktop computers and handheld computers, various alternative configurations are also deemed suitable and may employ various computing devices including servers, interfaces, systems, databases, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the rotes, responsibilities, or other functionality as discussed below with respect to the disclose apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

Figure 1:
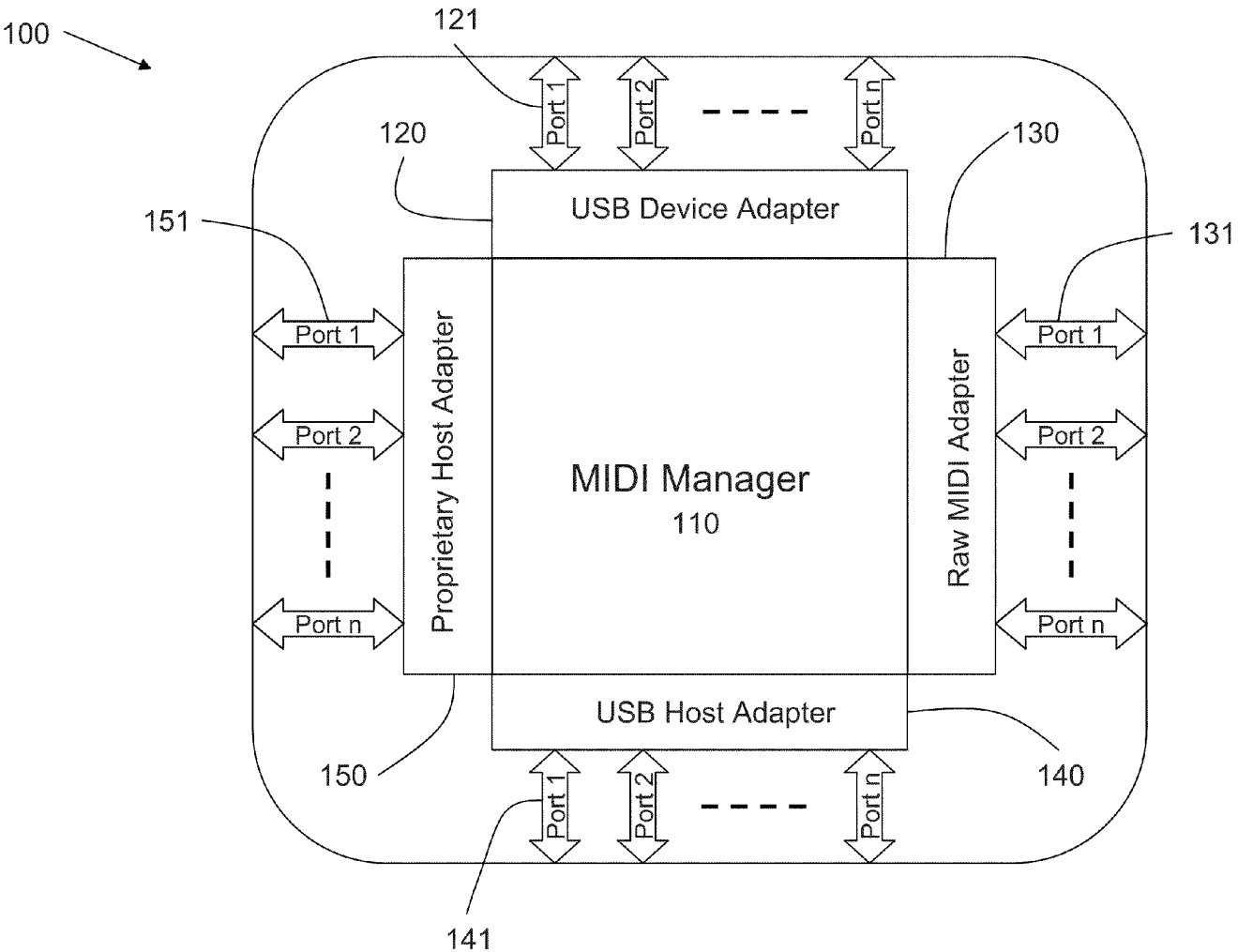
FIG. 1 is a functional diagram of an exemplary router of the present invention.

In FIG. 1, a router 100 has a MIDI manager 110, a USB device adapter 120, a raw MIDI adapter 130, a USB Host adapter 140, and a proprietary host adapter 150. Music event data manager 110 generally comprises a processor and memory (not shown) that process music event data, for example MIDI data. Each adapter 120, 130, 140 and 150 has ports 11, 131, 141, and 151, respectively, which could be used to provide coupling to external devices, such as instruments and control appliances. Such a coupling could be a physical coupling or a wireless coupling.

USB device adapter 120 is an adapter that couples to USB-MIDI transmitters and receivers, raw MIDI adapter 130 is an adapter that couples to MIDI devices, preferably using a serial connector, USB Host adapter 140 is an adapter that could couple either to a host computer system using a USB connector or to other USB-MIDI devices using a USB connector, and proprietary host adapter 150 is an adapter that couples to a host computer system using a proprietary connector with a proprietary operating system (for example a Palm™ Pilot operating system or an iPad™ operating system). Each of the adapters are used herein euphemistically as adapters that couple with devices that are capable of sending data through a port, and preferably each adapter is capable of sending music event data through a port. Other adapters could be coupled with MIDI manager 110 without departing from the scope of the invention to handle other protocols known in the art.

MIDI manager 110 handles the intelligent routing of event data messages between the various ports 121, 131, 141, and 151 on router 100 via adapters 120, 130, 140, and 150, respectively. Since each of the ports could transmit event data messages using a variety of protocols, music event data manager 110 preferably has drivers that can understand and translate event data messages from one protocol to another, or the drivers could be embedded in each driver individually, allowing for music event data manger 1110 to seamlessly communicate between each of the adapters as if each one of the adapters were using the same protocol, for example the MIDI 1.0 protocol or the HD-MIDI protocol. Conversion of event data from one protocol to another could be handled by either software or hardware elements without departing from the scope of the invention.

Figure 2:
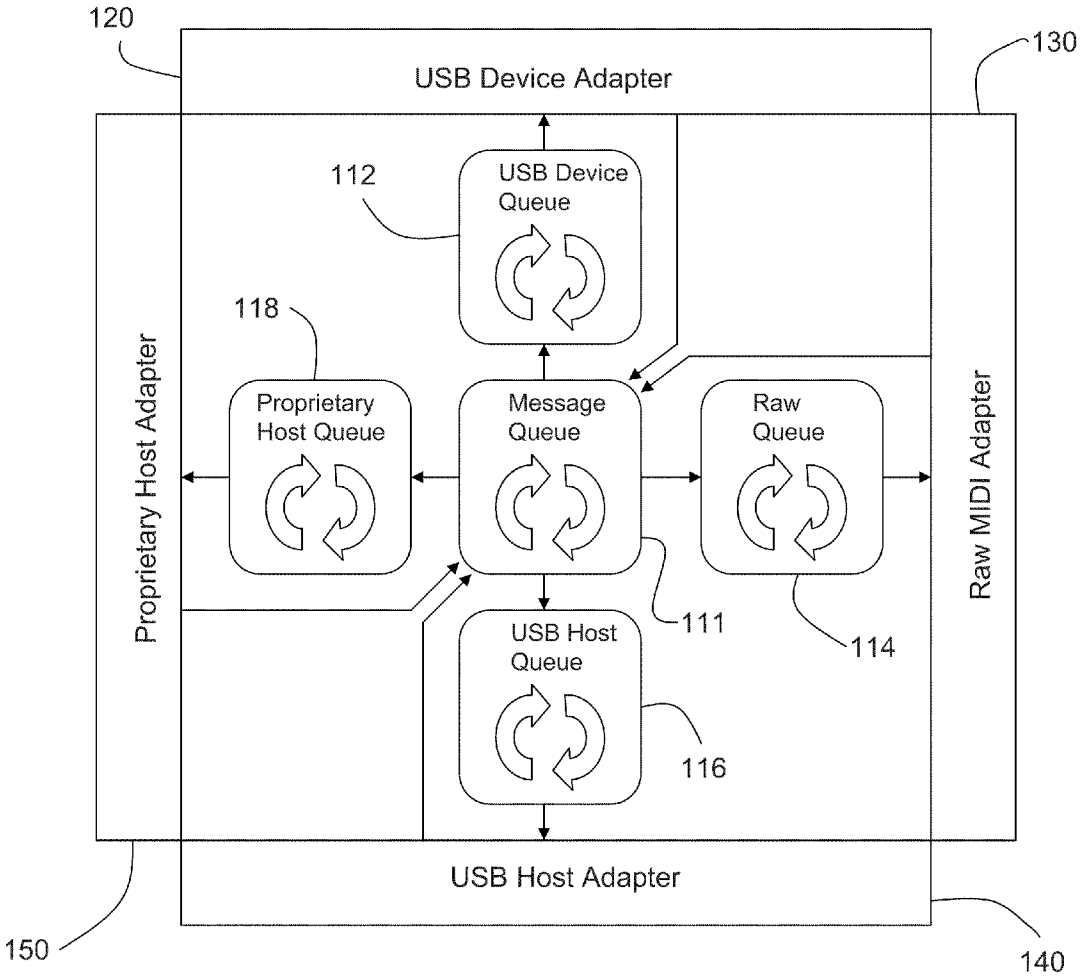
FIG. 2 is a close-up functional diagram of the manager of FIG. 1.

FIG. 2 shows a close-up view of an exemplary MIDI manager 110 with messaging queue 111, USE device queue 112, raw queue 114, USE host queue 116, and proprietary queue 118. In this close-up view, MIDI manager 110 utilizes a series of message queues and filters in order to handle incoming and outgoing MIDI data. Incoming messages from each of the adapters 120, 130, 140, and 150 are collected by messaging queue 111, which then processes each one of the messages, or events, to each of the queues 112, 114, 116, and 118. USE device queue 112 holds outgoing MIDI messages to USE ports connected to USE-MIDI devices through USE device adapter 120, raw queue 114 holds outgoing MIDI messages to standard MIDI DIN ports coupled to MIDI devices through raw MIDI adapter 130, USE host queue 116 holds outgoing MIDI messages to USE ports connected to host computers through USB host adapter 140, and proprietary host adapter queue 118 handles outgoing MIDI messages to a proprietary host computer system via proprietary host adapter 150.

In this embodiment, messages could be assumed to be valid when they are passed to a port. In order to avoid conflict, however, message filters could be incorporated to constrain the data to exclude inadvertent messages which could cause undesirable operation of either router 100 itself or to devices coupled to the ports. This filtering could be necessary when using instruments that malfunction when invalid messages are received. For example, a filter to prevent vibrato from being sent to a keyboard synthesizer. Filters could be applied to incoming ports or adapters to prevent events from being received by messaging queue 111, or filters could be applied to outgoing ports or adapters to prevent events from being sent to certain MIDI devices. In general, all messages are sent to host devices coupled to router 100, since most hosts can handle any event, even undefined events. However, it is contemplated that filters could be applied to certain hosts that require some error control handling, or to reduce the workload of messaging queue 118.

Figure 3A:
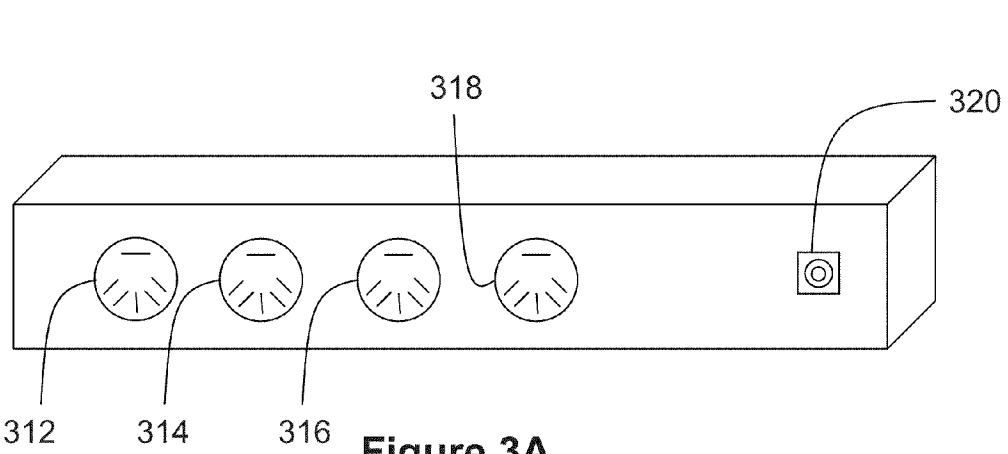
FIGS. 3A and 3B are front and rear views of another exemplary router of the present invention.
Figure 3B:
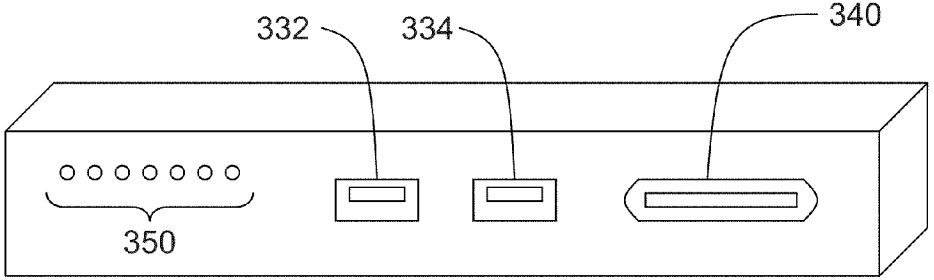

FIGS. 3A and 3B show an exemplary router 300, encapsulated in a housing with MIDI DIN inputs 312 and 314, MIDI DIN outputs 316 and 318, power connector 320, USB connectors 332 and 334, proprietary host connector 340, and indicator tights 350. MIDI DIN input 312 by default routes incoming MIDI event data to MIDI DIN output 316, and MIDI DIN input 314 by default routes incoming MIDI event data to MIDI DIN output 318. A user could couple a host computer to router 300 through either of USE connectors 332 or 334, or through proprietary host connector 340 to change the default routing profile of router 300. Preferably the default routing profile is then saved to flash memory and is loaded by the router every time the router is powered up. Indicator lights 350 correspond to each communication port on router 300, and will activate when a corresponding port is active. Power connector 320 accepts power for router 300, and is preferably configured to optimize power consumption depending on which ports are active by deactivating hardware associated with unconnected devices.

Preferably, USB connectors 332 and 334 are "smart connectors" which can determine whether a device coupled to the USB connector is a smart host computer system or a dumb MIDI transmitter or receiver. When a host computer is coupled to one of the USB connectors 332 and 334, router 300 will, by default, route all MIDI event data information to that host computer at all times, increasing the amount of information the attached host computer has at its disposal to assist in administration of MIDI music flowing through router 300. Once a user has properly configured router 300 through the host computer, the host computer could be removed from router 300.

Figure 4A:
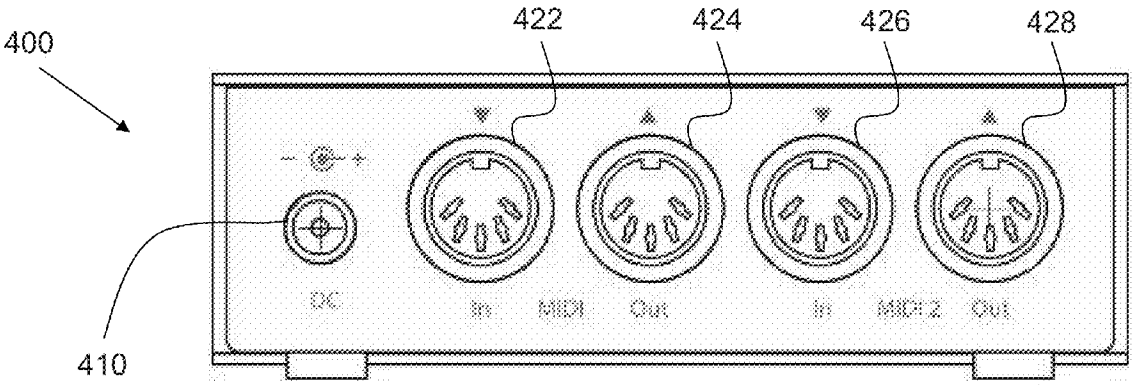
Figure 4B:
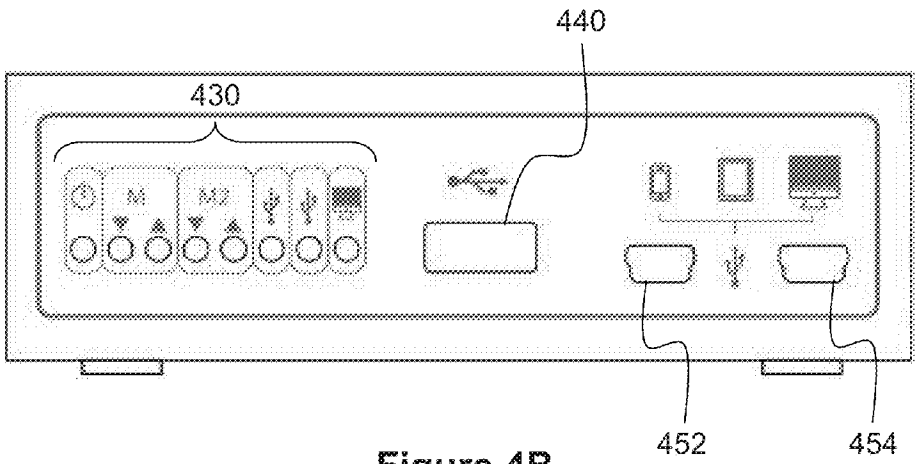

An alternative router 400 is shown in FIGS. 4A and 4B, with power connector 410, MIDI DIN IN/OUT port pair 422 and 424, MIDI DIN IN/OUT port pair 426 and 428, indicator lights 430, USB-MIDI port 440, and USB host ports 452 and 454. Alternative router 400 by default routes MIDI event data from port 422 to port 424, and MIDI event data from port 426 to port 428, USB-MIDI port 440 only accepts simple MIDI transmitters and/or receivers, and could be coupled with a USB hub to branch out to multiple USB-MIDI devices or to devices using other protocols, such as HD-MIDI. USB host ports 450 could be coupled to either dumb USB-MIDI devices, or to smart host computer systems, such as desktop host computer systems or handheld host computer systems. Indicator lights 430 will light up when a corresponding port is active, for example when the power connector 410 is active, when MIDI DIN IN port 422 is active, when MIDI DIN OUT port 424 is active, when MIDI DIN IN port 426 is active, when MIDI DIN OUT port 428 is active, when USB-MIDI port 440 is active, when USB host port 452 is active, or when USB host port 454 is active.

Figure 5:
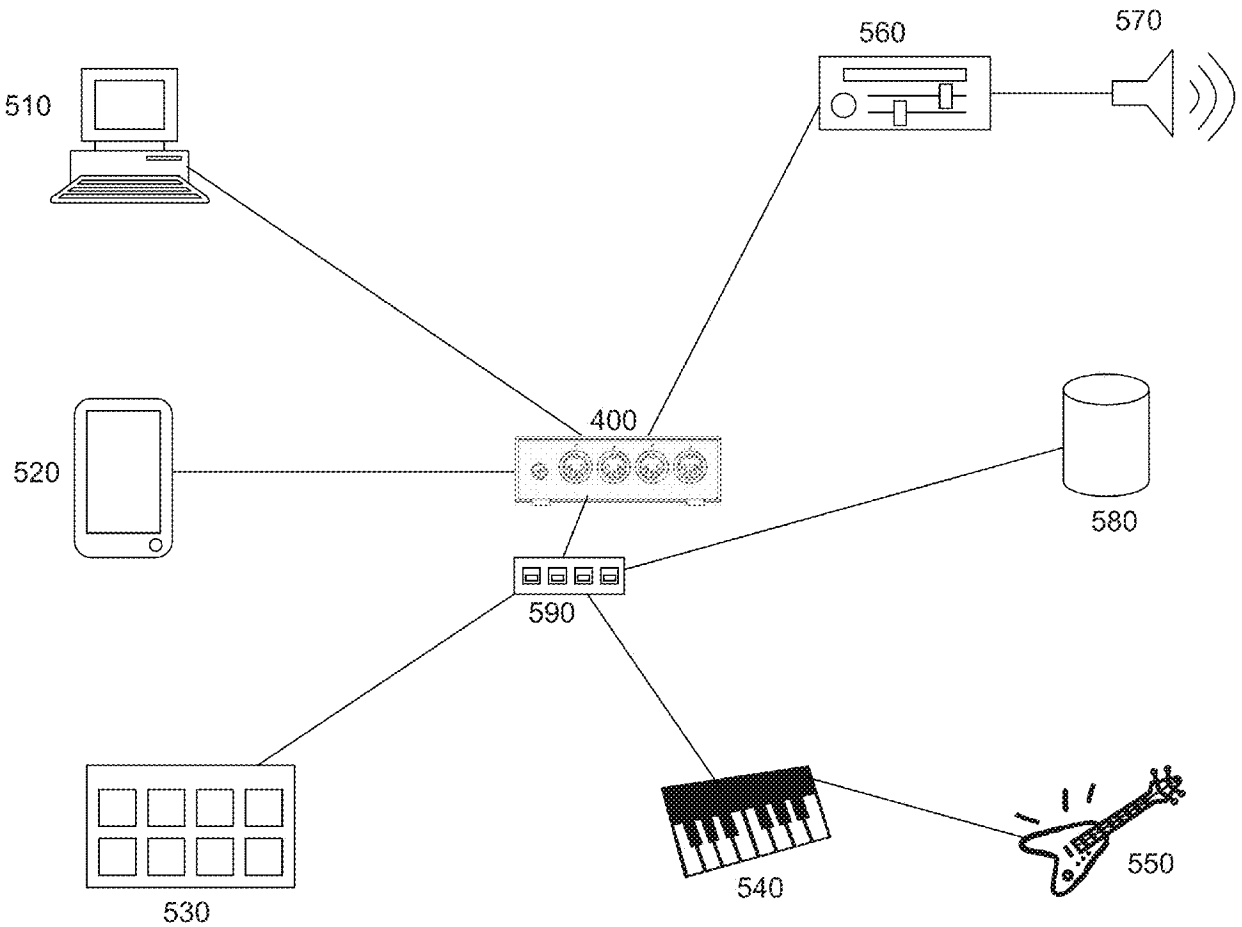
FIG. 5 is a schematic of the router of FIGS. 4A and 4B used with exemplary hosts, transmitters, and receivers.

FIG. 5 shows an exemplary system using router 400, with host desktop computer 510, host handheld computer 520, USB-MIDI drum pad 530, USB-MIDI keyboard 540, USB-MIDI guitar 550, synthesizer 560, speaker 570, storage device 580, and USB hub 590. Host desktop computer 510 is used to access the user interface on router 400 to designate that the writ signals from host handheld computer 520, drum pad 530, keyboard 540, and guitar 550, be merged and sent to synthesizer 560 and storage device 580 simultaneously or substantially simultaneously. As used herein, substantially simultaneously are signals that are sent within 0.1 second from one another, and are preferably sent within 0.01 second from one another.

Host handheld computer 520 has an accelerometer that could translate the angle that the host handheld computer 520 is tilted at into MIDI pitch event data which is then sent to router 400. USB hub 590 allows up to four devices to be coupled to its ports, which allows the plurality of devices coupled to USB hub 590 to be realized by a virtual addressing scheme adopted by router 400. USB-MIDI devices could be coupled to USB hub in parallel, such as with drum pad 530 and keyboard 540, or in serial, such as with keyboard 540 and guitar 550. The signals from each of these devices are then merged by router 400 and MIDI event data is then sent to synthesizer 560 to be played on speaker 570, and is sent to storage device 580 to be saved. After host computer 510 configures the appropriate routing for the devices, host computer 510 could be removed from the system without impacting the transmission of MIDI event data from the instruments to synthesizer 560 and storage device 580. In fact, host computer 520 could also be removed, if pitch data is no longer wanted by the users playing the instruments.

Figure 6:
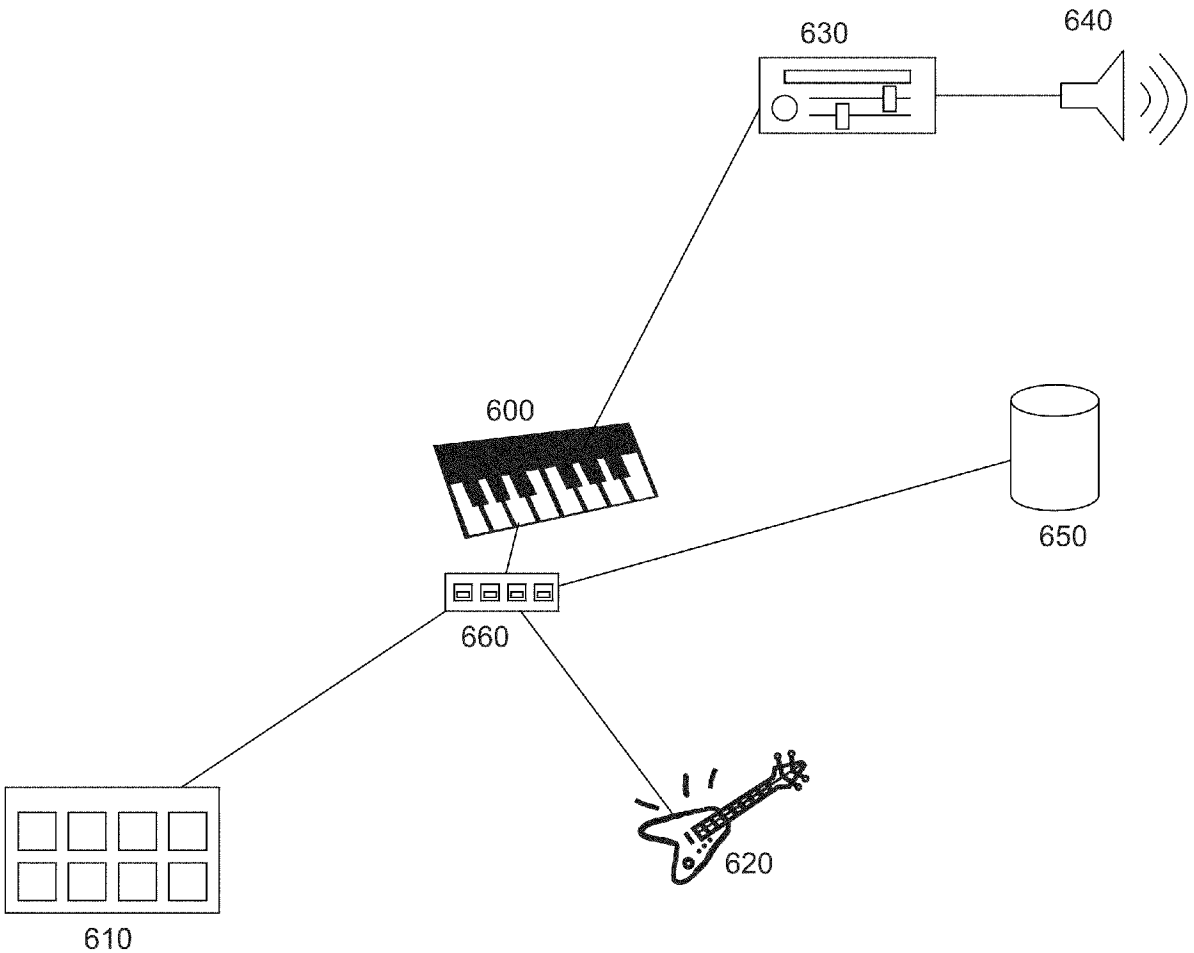
FIG. 6 is a schematic of a router embedded in a keyboard used with exemplary transmitters and receivers.

FIG. 6 shows another exemplary system using a router embedded in keyboard 600. Keyboard 600 has the ports of router 400, but also has the functionality of producing MIDI event data information in response to keys pressed on the electric keyboard. Keyboard 600 has a drum pad 610 and guitar 620 coupled to it via USB hub 660, and sends the merged f\MIDI event data to speaker 640 through synthesizer 630, and to storage device 650 through USB hub 660.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device for routing music events, comprising:

a plurality of ports that transmit digital music event data, wherein the plurality of ports comprise a first USB port and a USB second port, wherein the device hostlessly reproduces digital music event data from a first transmitter coupled to the first port and transmits the reproduced digital music event data to a first receiver coupled to the second port; and wherein the device receives digital music event data from the first transmitter via a first protocol and the device transmits digital music event data to the first receiver via a second protocol.

2. The device of claim 1, further comprising a first data interface that accepts instructions from a host to transmit the reproduced digital event data to a second receiver coupled to a third port of the plurality of ports.

3. The device of claim 2, wherein the reproduced digital event data is transmitted to the first receiver and the second receiver simultaneously.

4. The device of claim 2, further comprising a second data interface that accepts instructions from a second host to reproduce digital music event data.

5. The device of claim 1, wherein the device hostlessly produces a merged digital music event data stream from the digital music event data from the first transmitter with digital music event data from a second transmitter coupled to at least one of the plurality of ports.

6. The device of claim 5, wherein the device hostlessly transmits the merged digital music event data stream to the first receiver.

7. The device of claim 1, wherein the plurality of ports comprise at least one pair of MIDI DIN IN/OUT ports.

8. The device of claim 1, wherein the plurality of ports comprise virtual ports whose plurality are realized using a hub coupled to the device.

9. The device of claim 1, further comprising a first data interface that accepts instructions from a host to filter out digital music event data received from the first transmitter.

10. The device of claim 1, further comprising a first data interface that accepts instructions from a host to filter out digital music event data reproduced by the device.

11. The device of claim 1, wherein the the first transmitter is a different device than the first receiver.

12. The device of claim 11, wherein the first protocol is MIDI and wherein the second protocol is USB-MIDI.

13. The device of claim 11, wherein the first protocol and the second protocol are different versions of the MIDI protocol.

14. The device of claim 1, further comprising a second transmitter that transmits digital music event data to at least one of the plurality of ports.

15. The device of claim 14, wherein the second transmitter is selected from the group consisting of an electric piano and an electric guitar.

16. The device of claim 1, further comprising a second transmitter that merges digital music event data with the reproduced digital music event data and transmits the merged digital music event data to the first receiver.

17. The device of claim 1, further comprising a second receiver that generates sound that corresponds to the reproduced digital event data.

18. The device of claim 1, further comprising a memory that records the reproduced digital music event data.

19. A device for routing music events, comprising:

a plurality of ports including a first port and a second port, wherein the plurality of ports are configured to transmit digital music event data;

a memory having a routing profile stored therein;

wherein the device is configured to hostlessly (i) reproduce digital music event data from a first transmitter coupled to the first port and (ii) transmit the reproduced digital music event data to a first receiver coupled to the second port according to the routing profile; and wherein the plurality of ports comprise virtual ports that are realized using a hub coupled to the device.

20. A device for routing music events, comprising:

a plurality of ports that transmit digital music event data, wherein the plurality of ports have a first port and a second port;

wherein the device hostlessly reproduces digital music event data from a first transmitter coupled to the first port and transmits the reproduced digital music event data to a first receiver coupled to the second port; and wherein the device receives digital music event data from the first transmitter via a first protocol and the device transmits digital music event data to the first receiver via a second protocol.

21. The device of claim 20, wherein the plurality of ports comprise virtual ports that are realized using a hub coupled to the device.

22. The device of claim 20, further comprising a second transmitter that transmits digital music event data to at least one of the plurality of ports.

23. The device of claim 20, further comprising a second receiver coupled to a third port of the device, wherein the first transmitter transmits the reproduced digital music event data to a second receiver via a third protocol.

24. The device of claim 23, wherein the first protocol is MIDI, the second protocol is USB-MIDI, and the third protocol is MIDI 2.0.

25. The device of claim 23, wherein the device filters out specific music event data received by the first transmitter before transmitting the reproduced digital music event data to the second receiver.

26. The device of claim 20, wherein the device designates a delay between receiving music event data from the first transmitter and transmitting reproduced music event data to the first receiver.

* * * * *